US012179992B1

(12) United States Patent
Yang

(10) Patent No.: US 12,179,992 B1
(45) Date of Patent: Dec. 31, 2024

(54) CARD STORAGE BOX

(71) Applicant: Xiaohui Yang, Hunan Province (CN)

(72) Inventor: Xiaohui Yang, Hunan Province (CN)

( * ) Notice: Subject to any disclaimer, the term of this patent is extended or adjusted under 35 U.S.C. 154(b) by 0 days.

(21) Appl. No.: 18/431,720

(22) Filed: Feb. 2, 2024

(30) Foreign Application Priority Data

Jan. 22, 2024 (CN) ..... 202420162539.6

(51) Int. Cl.
*B65D 83/08* (2006.01)

(52) U.S. Cl.
CPC ..... *B65D 83/0894* (2013.01); *B65D 2585/30* (2013.01)

(58) Field of Classification Search
CPC ..... B65D 25/06; B65D 83/0894; B42F 17/02
USPC ..... 206/315.1, 425, 523, 561, 579; 220/528, 220/532, 533, 553, 831, 833, 845; 40/124.2
See application file for complete search history.

(56) References Cited

U.S. PATENT DOCUMENTS 2,695,112 A * 11/1954 Bonnevay ..... A45C 13/02 206/523
4,003,468 A * 1/1977 Berkman ..... G11B 23/0236 206/307.1
4,093,010 A * 6/1978 Hunley ..... A45C 13/02 D3/319
4,106,597 A * 8/1978 Shook ..... A45C 13/02 190/110
4,433,781 A * 2/1984 Hummel ..... G10G 7/005 206/592
4,629,066 A * 12/1986 Howard ..... G11B 23/0236 190/110
4,733,806 A * 3/1988 Sloop ..... A45F 3/02 224/601
5,257,721 A * 11/1993 Smith ..... B44D 3/04 220/831
5,299,688 A * 4/1994 McKay ..... A45C 11/18 206/425
10,569,412 B1 * 2/2020 Reyes ..... B25H 3/021
2007/0062839 A1 * 3/2007 Patterson ..... B25H 3/02 206/523

* cited by examiner

*Primary Examiner* — Luan K Bui

(57) ABSTRACT

A card storage box includes a storage box body, a flexible part and a plurality of dividers. The storage box body is provided with a first accommodating space inside, the first accommodating space is configured for storing cards. The flexible part is arranged within the first accommodating space to protect stored cards. The dividers is arranged in the first accommodating space to divide the first accommodating space into a plurality of first storage spaces. The flexible part can provide a certain level of cushioning. When cards are subjected to external impacts or compression, the flexible part can reduce the force of impact, helping to prevent damage to edges or corners of the cards. In addition, the flexible part effectively reduces direct contact between card surfaces and a hard shell of the box, thereby decreasing the likelihood of scratches and wear, effectively protecting the cards, greatly enhancing the user experience.

14 Claims, 8 Drawing Sheets

CARD STORAGE BOX

CROSS-REFERENCE TO RELATED APPLICATIONS

The application claims priority of Chinese patent application CN2024201625396, filed on Jan. 22, 2024, which is incorporated herein by reference in its entireties.

TECHNICAL FIELD

The present disclosure relates to the technical field of storage boxes, particularly to a card storage box.

BACKGROUND

Currently available card storage boxes on the market are mostly made of hard shell materials. The hard shell boxes can exert considerable pressure on cards during storage, leading to potential damage, especially to edges and corners of the cards. Therefore, there is an urgent need in the market for a storage box made of soft materials or a hard storage box with a soft lining to reduce potential damage to the cards.

SUMMARY

In order to overcome the shortcomings of the prior art, the present disclosure provides a card storage box, including: a storage box body is provided with a first accommodating space, the first accommodating space configured to store cards; a flexible part arranged in the first accommodating space to protect stored cards; and a plurality of dividers arranged in the first accommodating space to divide the first accommodating space into a plurality of first storage spaces.

As the improvement of the present disclosure, the storage box body includes a first shell body with a storage opening and a second shell body rotatably connected to the first shell body, and the first shell body and the second shell body jointly form the first accommodating space.

As the improvement of the present disclosure, the storage box body further includes a box body and a lid, the box body is arranged in the first shell body, and the lid is arranged in the second shell body, the box body and the lid together form the first accommodating space, and the first accommodating space is connected to outside through the storage opening.

As the improvement of the present disclosure, the dividers further includes a first divider and a second divider, the first divider is configured to divide the first accommodating space into a plurality of first storage spaces, and the second divider is detachably installed in the first storage spaces to divide the first storage space into a plurality of second storage spaces.

As the improvement of the present disclosure, the first divider is provided with a plurality of installation slots, the second divider is provided with a installation component, the installation component is installed in the installation slots such that the second divider can be detachably installed in the first storage space and divide the first storage spaces into a plurality of second storage spaces.

As the improvement of the present disclosure, the second divider further includes a pull component configured to the installation and detachment of the second divider in the installation slots.

As the improvement of the present disclosure, the flexible part is arranged in the first accommodating space and connected to the lid to protect the stored cards.

As the improvement of the present disclosure, the card storage box further includes a connecting component, wherein the second shell body is rotatably connected to the first shell body through the connecting component.

As the improvement of the present disclosure, the storage box body includes a front side and a back side opposite to the front side, the connecting component includes a connecting component configured for rotational connection and a limiting component for positioning, and the connecting component and the limiting component are arranged on the back side of the storage box body.

As the improvement of the present disclosure, an end of the connecting component is connected to the first shell body, and the other end of the connecting component is connected to the second shell body, allowing the second shell body to be rotatably connected to the first shell body through the connecting component.

As the improvement of the present disclosure, the second shell body is rotatably connected to the first shell body through the connecting component, allowing the second shell body to switch between an open state and a closed state.

As the improvement of the present disclosure, the connecting component includes a first connecting component and a second connecting component, the first connecting component is fixed to the first shell body, the second connecting component is fixed to the second shell body, and the second connecting component is rotatably connected to the first connecting component, allowing the second shell body to be rotatably connected to the first shell body.

As the improvement of the present disclosure, the first connecting component further includes a first fixing hole, and the second connecting component further includes a second fixing hole, a first end of the limiting component is inserted into the first fixing hole, a second end of the limiting component is inserted into the second fixing hole. when the second shell body rotates to the open state, the limiting component is configured to support the second shell body in the open state.

As the improvement of the present disclosure, the card storage box further includes a switch component, when the second shell body rotates to the closed state, the switch component is configured to fix the second shell body in the closed state.

As the improvement of the present disclosure, the switch component includes an upper switch component and a lower switch component opposite to the upper switch component, the upper switch component is arranged on the second shell body, the lower switch component is arranged on the first shell body, the switch component also includes a third connecting component, the third connecting component is configured to connect the upper switch component with the lower switch component, thus fixing the second shell body in the closed state.

As the improvement of the present disclosure, the third connecting component includes a snap fastener and a connecting ring, the connecting ring is connected to the snap fastener, and the connecting ring is provided with a snap-fit, the upper switch component is provided with a socket, when the snap-fit is inserted into the socket, pressing down on the snap fastener causes the snap-fit to be fixed in the socket, thus relatively fixes the upper switch component to the lower switch component, thereby securing the second shell body in the closed state.

As the improvement of the present disclosure, the storage box body further includes a handle component rotatably connected to the first shell body, the first shell body is provided with a handle installation component, the handle installation component is provided with an installation slot, the handle component is provided with a positioning post, when the positioning post is inserted into the installation slot, the handle component can be rotatably installed on the handle installation component, allowing the handle component to be rotatably connected to the first shell body.

As the improvement of the present disclosure, an outer surface of the storage box body is covered with waterproof material.

As the improvement of the present disclosure, the back side of the storage box body is also provided with support legs, the support legs includes a first support leg and a second support leg, the first support leg is arranged on the first shell body, and the second support leg is arranged on the second shell body.

As the improvement of the present disclosure, the storage box body further includes an anti-slip pad arranged on a bottom surface of the first shell body.

The beneficial effects of the present disclosure are as follows: the present disclosure provides a card storage box, the card storage box includes a storage box body, the storage box body is provided with a first accommodating space inside, the first accommodating space is configured for storing cards; a flexible part, the flexible part is arranged in the first accommodating space to protect stored cards; and a plurality of dividers, the dividers is arranged in the first accommodating space to divide the first accommodating space into a plurality of first storage spaces. The flexible part can provide a certain level of cushioning. When cards are subjected to external impacts or compression, the flexible part can reduce the force of impact, helping to prevent damage to edges or corners of the cards. In addition, the flexible part effectively reduces direct contact between card surfaces and a hard shell of the box, thereby decreasing the likelihood of scratches and wear, effectively protecting the cards, greatly enhancing the user experience.

BRIEF DESCRIPTION OF THE DRAWINGS

In order to explain the technical solutions of the embodiments of the present disclosure more clearly, the following will briefly introduce the accompanying drawings used in the embodiments. The drawings in the following description are only some embodiments of the present disclosure. Those of ordinary skill in the art can obtain other drawings based on these drawings without creative work.

The present disclosure is further described below in detail in combination with the accompanying drawings and embodiments.

DETAILED DESCRIPTION OF THE EMBODIMENTS

Figure 1:
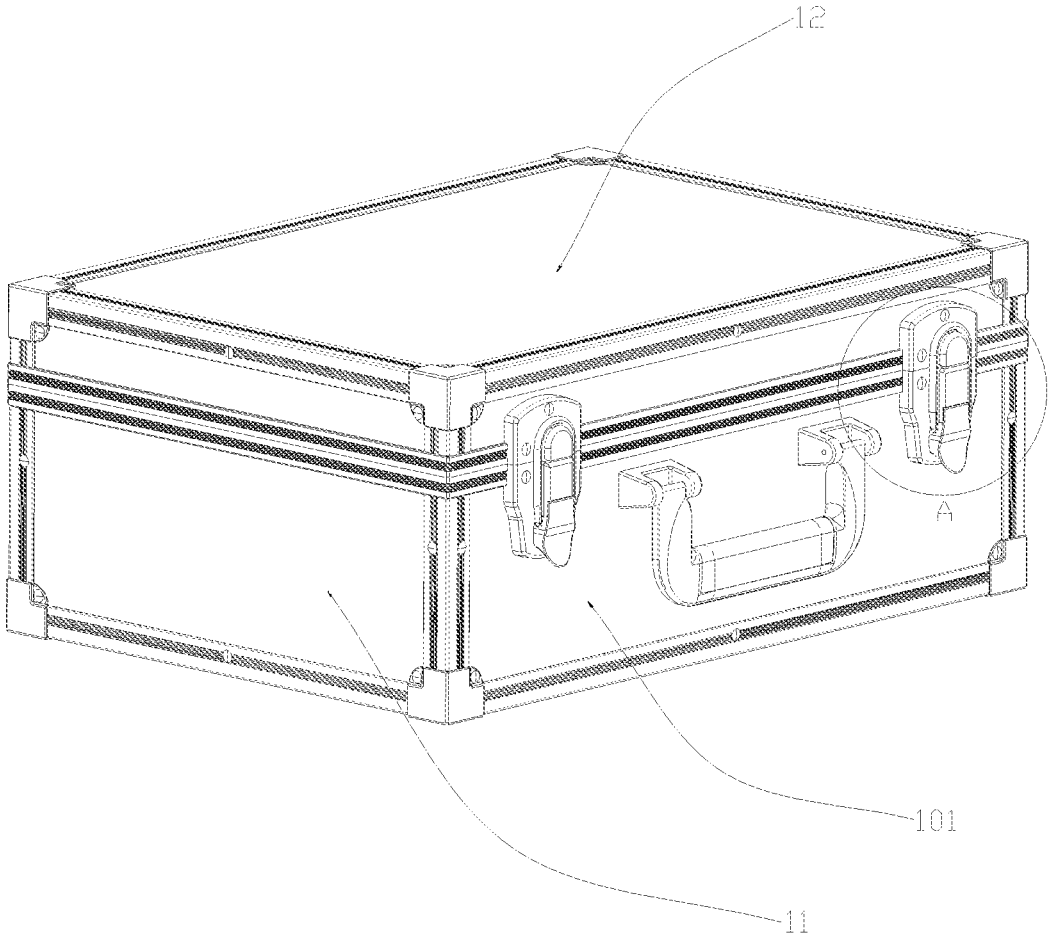
FIG. 1 is a schematic view of an overall structure of the present disclosure from a front.
Figure 2:
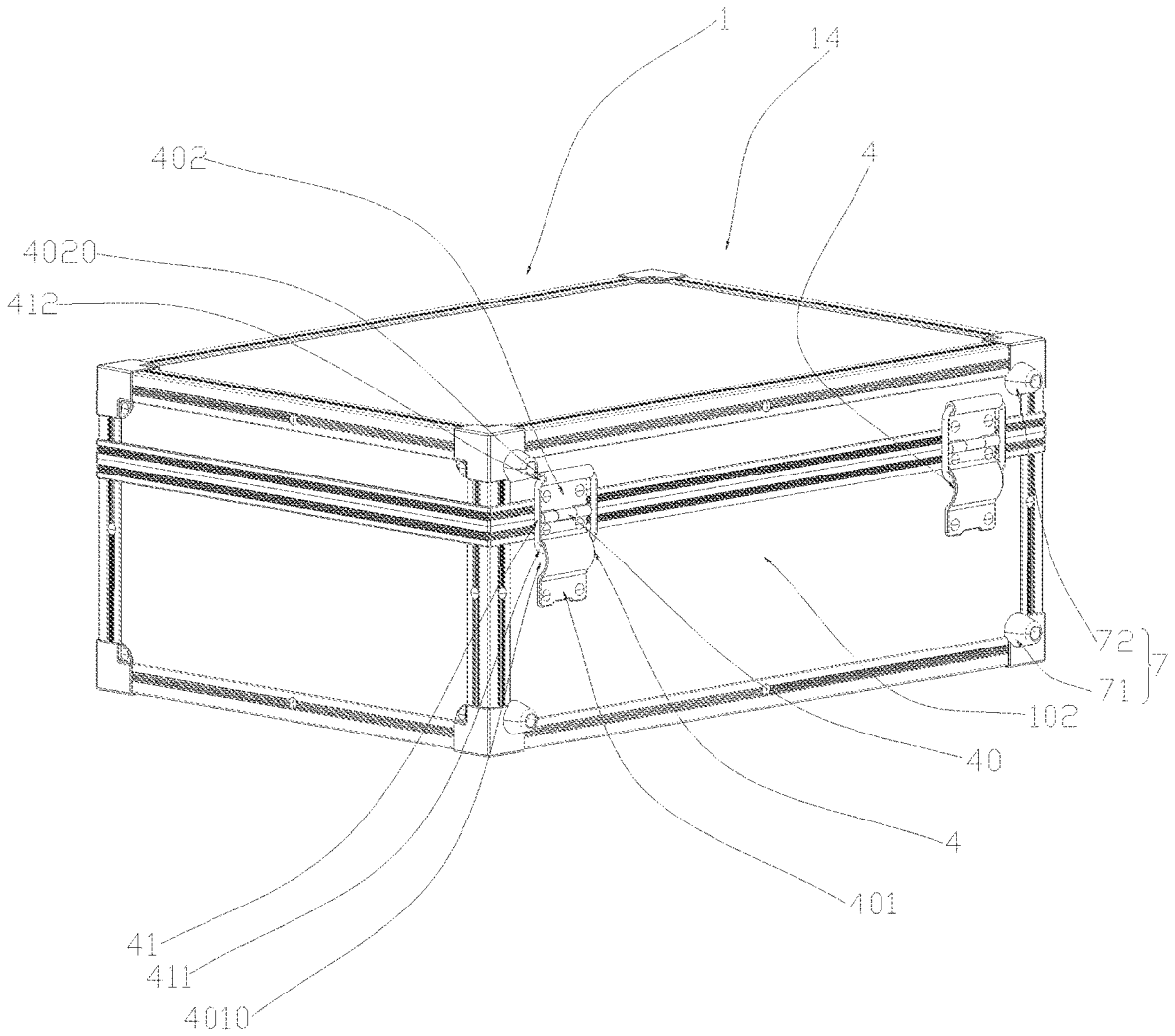
FIG. 2 is a schematic view of the overall structure of the present disclosure from a back.
Figure 3:
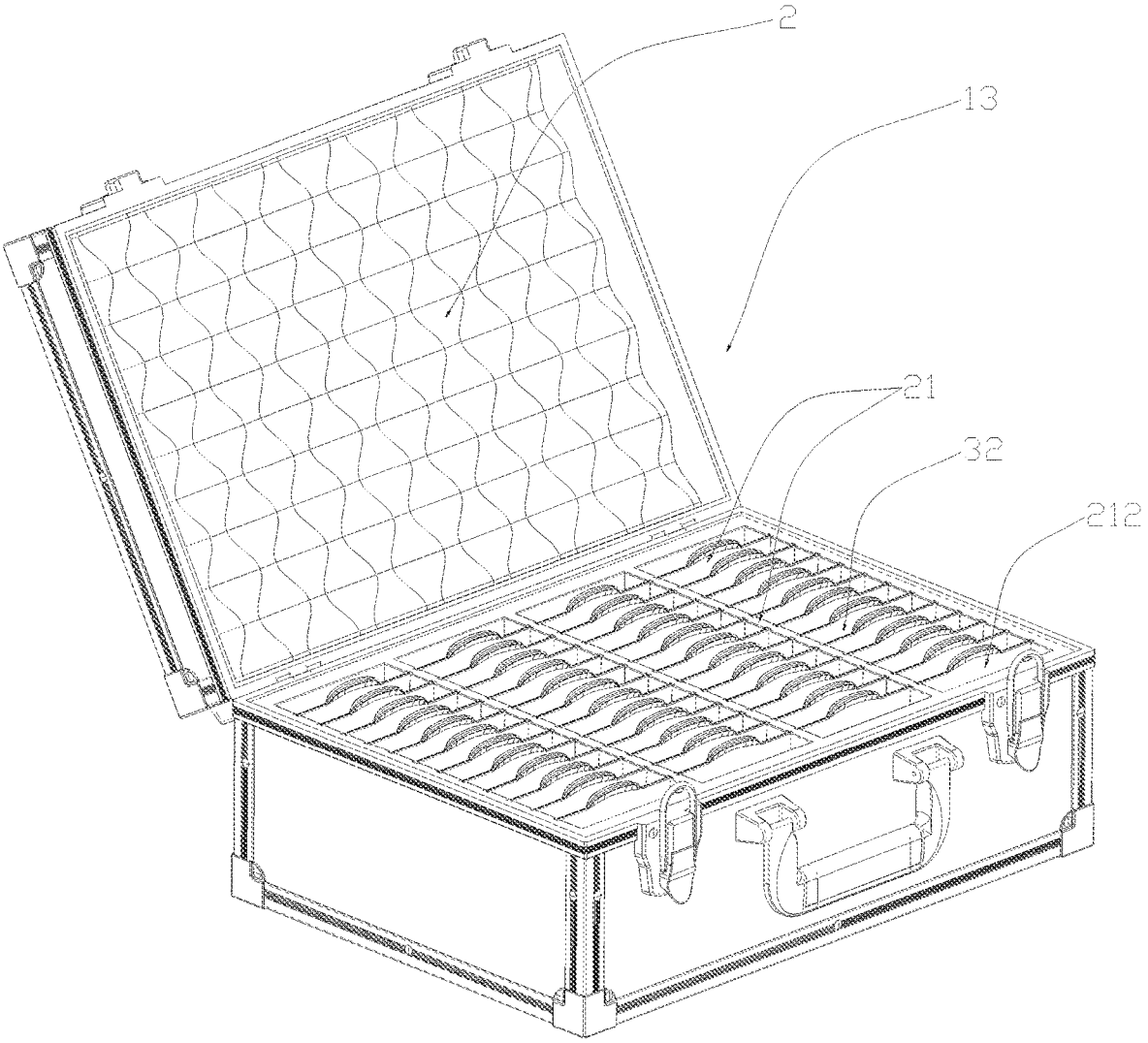
FIG. 3 is a schematic view of the overall structure of the present disclosure in an open state.
Figure 4:
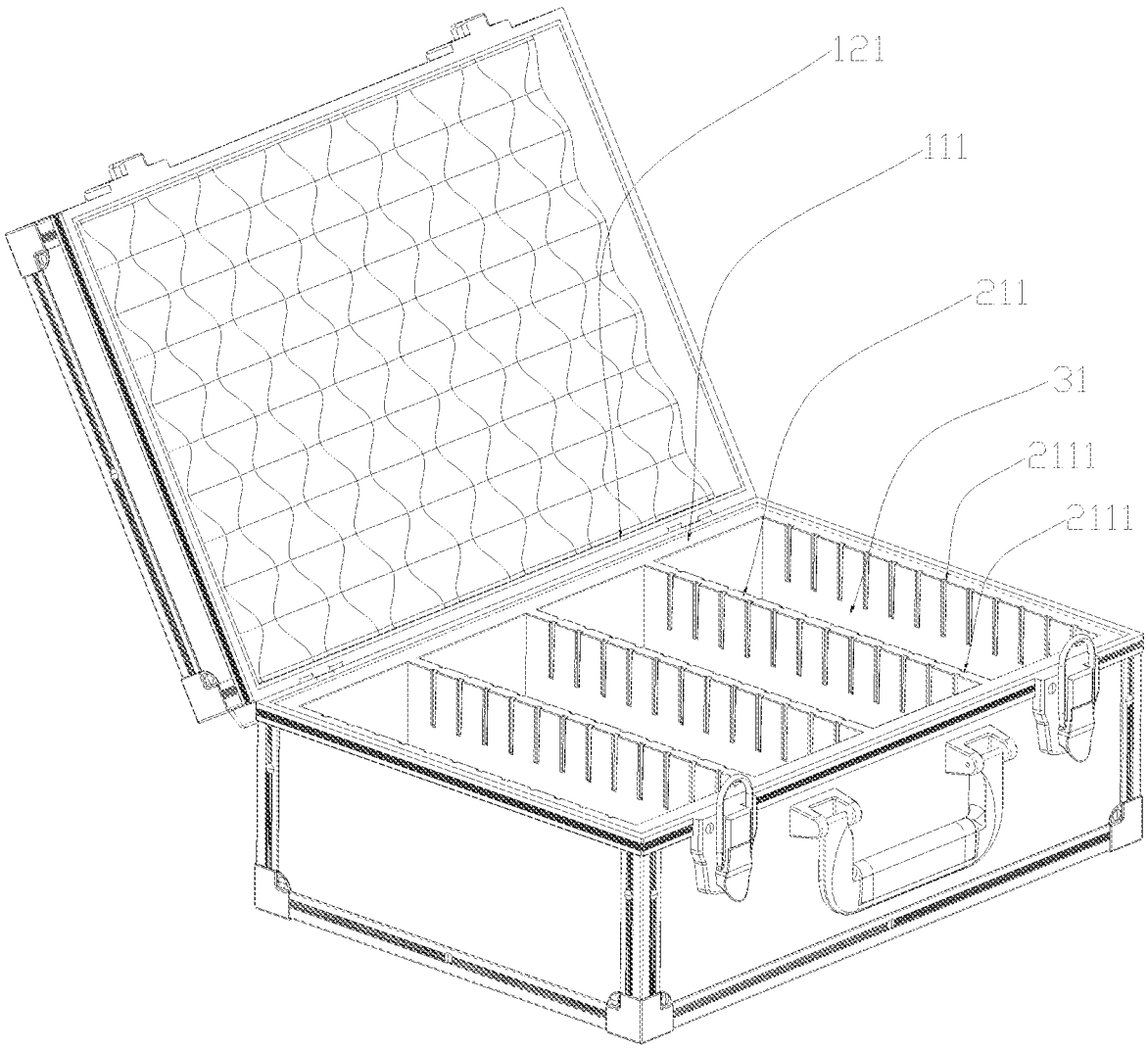
FIG. 4 is a schematic view of a partial structure of the present disclosure in the open state.
Figure 5:
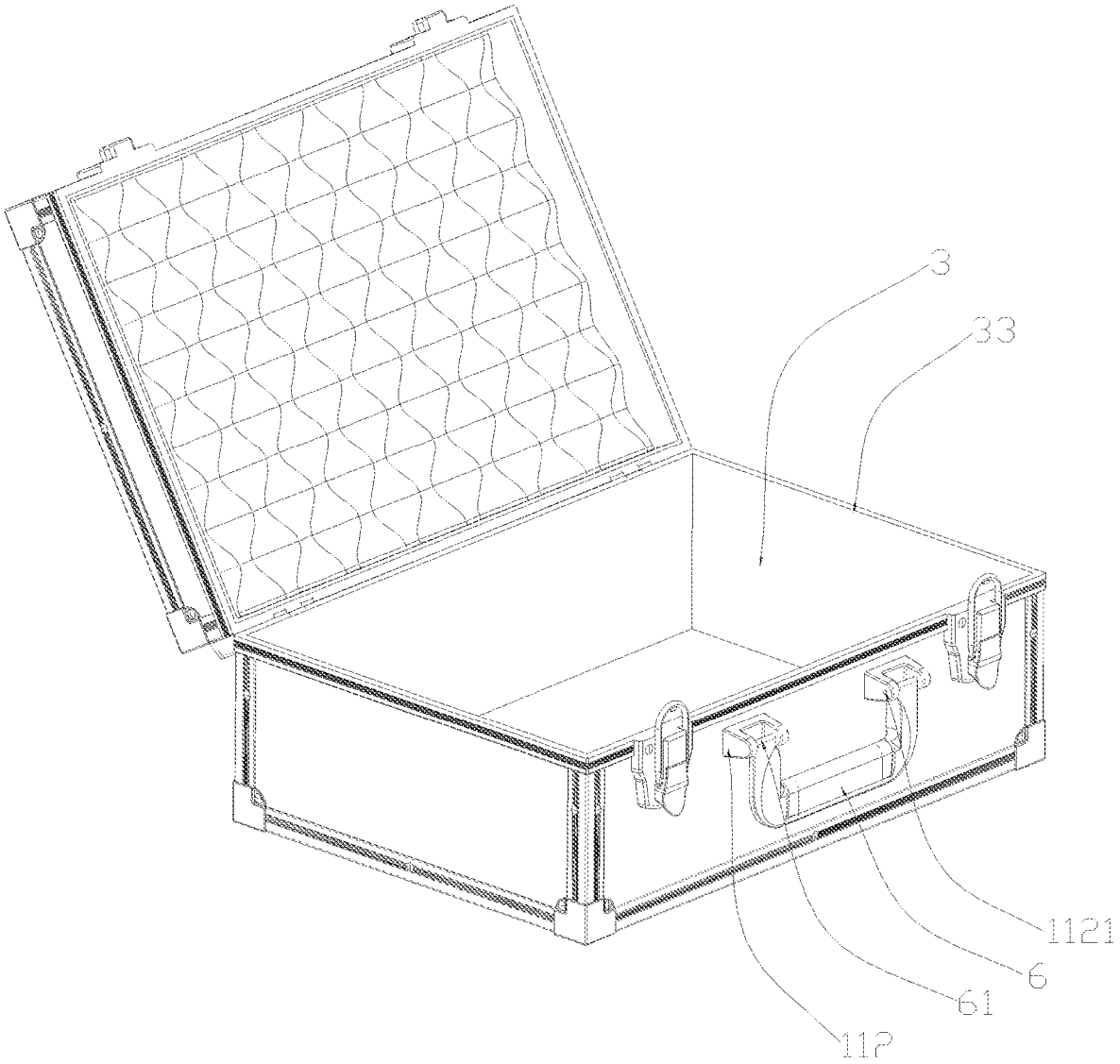
FIG. 5 is a schematic view of another partial structure of the present disclosure in the open state.
Figure 6:
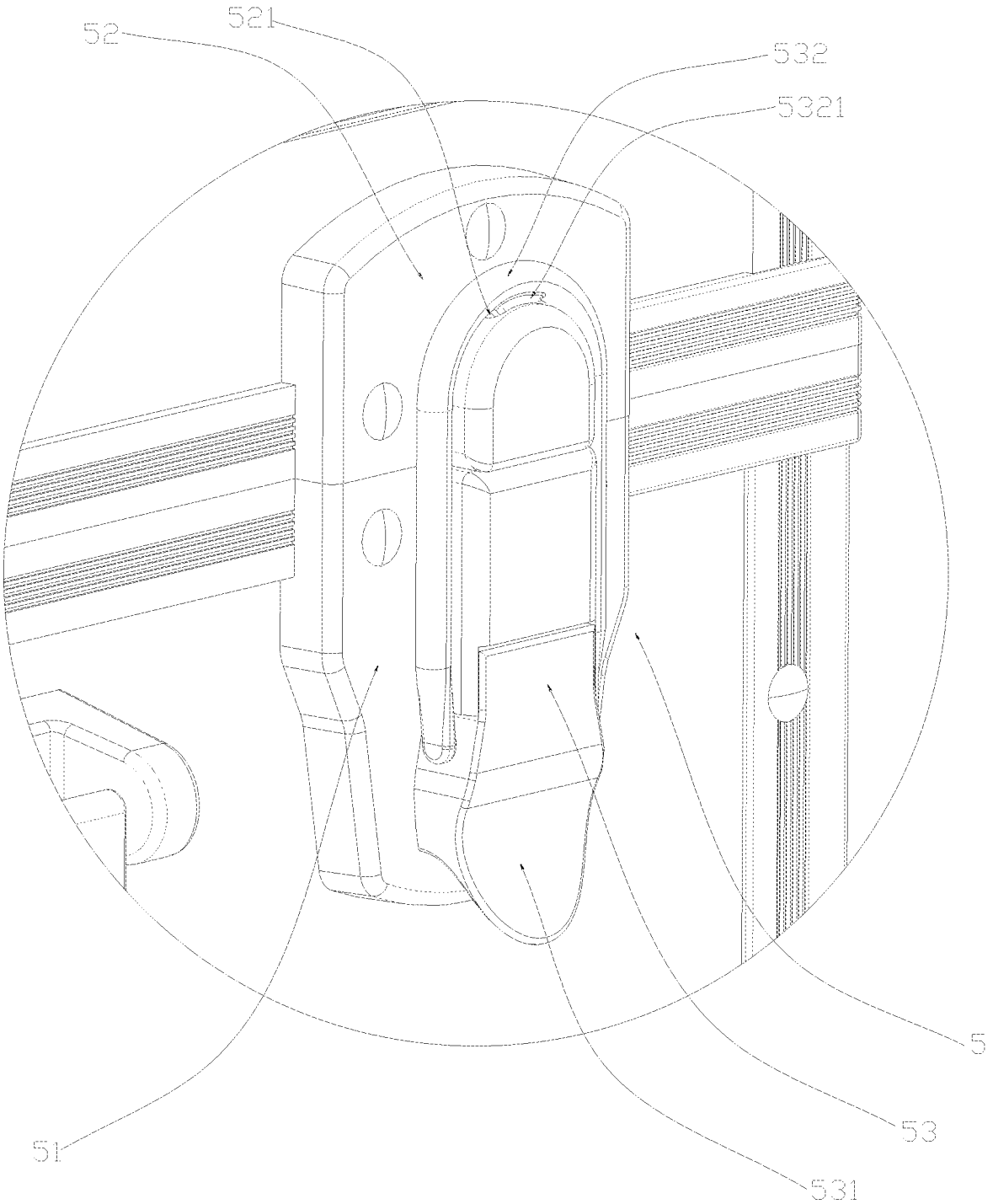
FIG. 6 is an enlarged view of a part indicated by A in FIG. 1 of the present disclosure.
Figure 7:
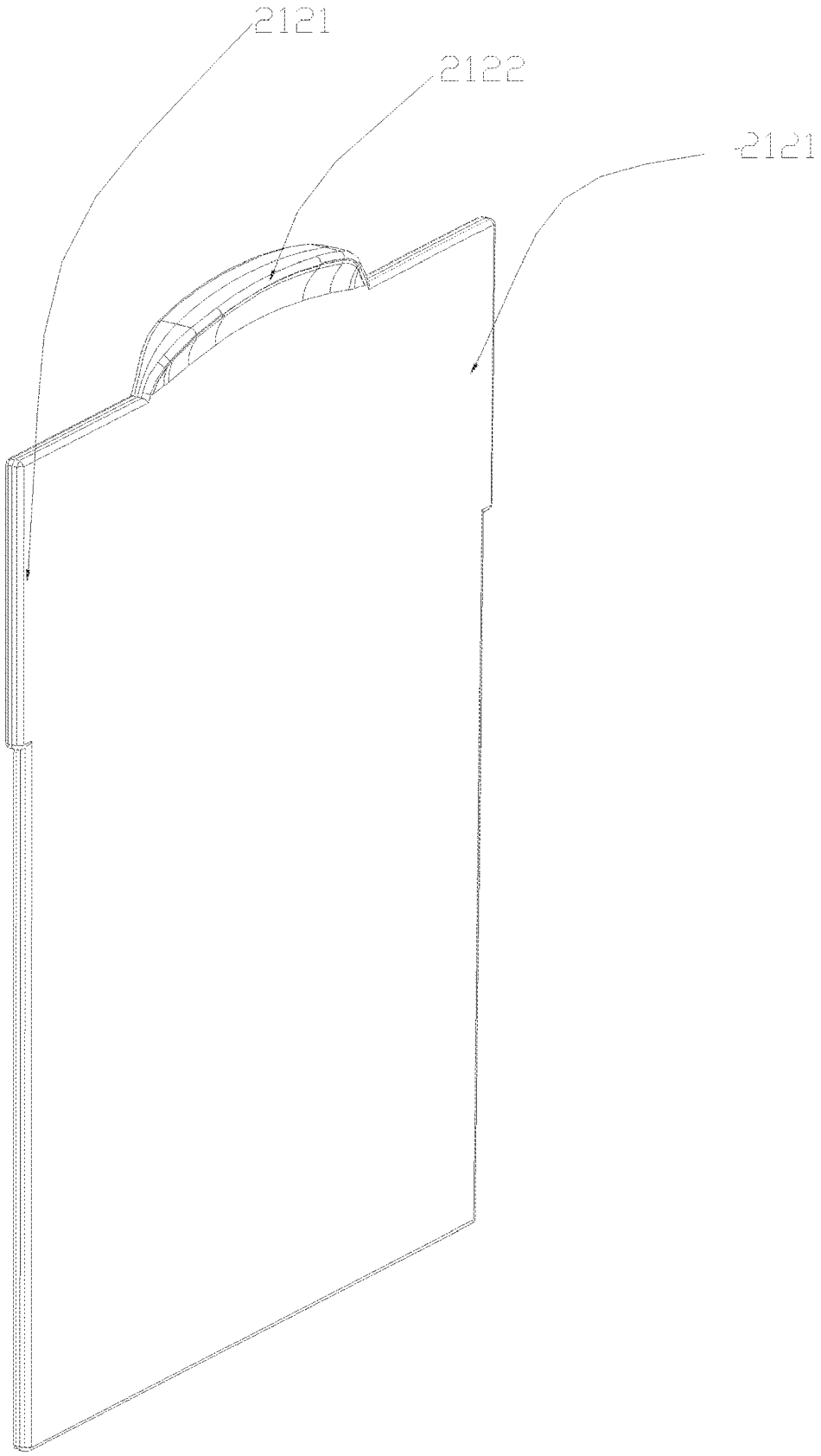
FIG. 7 is a schematic view of a structure of a second divider of the present disclosure.
Figure 8:
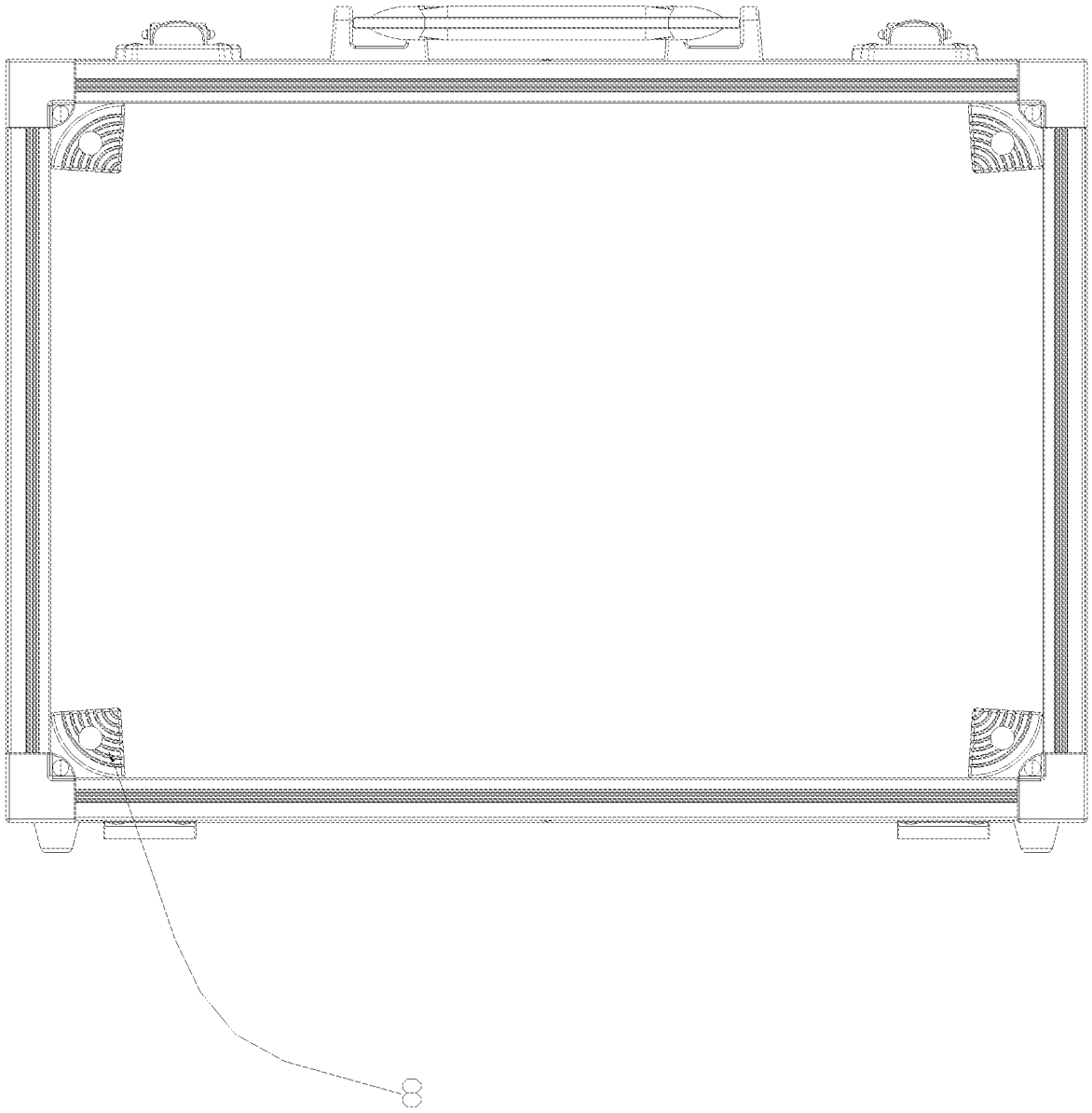
FIG. 8 is a schematic view of a bottom structure of the present disclosure.

Referring to FIG. 1 to FIG. 8, a card storage box includes: a storage box body 1, a flexible part 2, and a plurality of divider parts 21.

The storage box body 1 is provided with a first accommodating space 3 inside, the first accommodating space 3 is configured for storing cards.

The flexible part 2 is located in the first accommodating space 3 to protect the stored cards.

A plurality of divider parts 21 is located in the first accommodating space 3 to divide the first accommodating space 3 into a plurality of first storage spaces 31. The flexible part 2 placed in the first accommodating space 3 is to prevent the cards from contacting and wearing against the storage box body 1. The flexible part 2 can be various soft materials such as foam pads, silicone pads, leather pads, fiber pads, cloth pads, etc. By using the divider parts 21 to create a plurality of first storage spaces 31, users can categorize and store their cards more efficiently, enhancing the user experience.

In this embodiment, the storage box main body 1 includes a first shell 11 with a storage opening 33 and a second shell 12 rotatably connected to the first shell 11. The first shell 11 and the second shell 12 together form the first accommodating space 3. Additionally, the storage box main body 1 includes a box body 111 and a lid 121. The box body 111 is located inside the first shell 11, and the lid 121 is located inside the second shell 12. The box body 111 and the lid 121 collectively create the first accommodating space 3, the accommodating space 3 connects with exterior through the storage opening 33. The box body 111 and the first shell 11, as well as the lid 121 and the second shell 12, are not made as a single unit, allowing for easy cleaning by users.

In this embodiment, the divider part 21 further includes a first divider part 211. The first divider part 211 is configured to divide the first accommodating space 3 into a plurality of first storage spaces 31. The divider part 21 also includes a second divider part 212, the second divider part 212 is detachably installed in the first storage space 31 to divide the first storage space 31 into a plurality of second storage spaces 32. The first divider part 211 is provided with a plurality of installation slots 2111, and the second divider part 212 is provided with an installation component 2121, the installation component 2121 is installed in the installation slots 2111 such that the second divider part 212 can be detachably installed in the first storage space 31 and divide the first storage space 31 into a plurality of second storage spaces 32. The second divider part 212 also includes a pull component 2122, the pull component 2122 is configured to install and detach the second divider part 212 in the installation slots 2111. The second divider part 21 is configured to divide the first storage space 31 into a plurality of second storage spaces 32, allowing for detailed categorization and storage. Furthermore, due to the detachable and optional nature of the second divider part 21, users can categorize based on actual usage scenarios, enhancing the user experience. In addition, the pull component 2122 facilitates the users in installing and detaching the second divider part 212 in the first storage space 31.

In this embodiment, a flexible part 2 is placed inside the first accommodating space 3 and connected to the lid 121 to protect the stored cards. The methods of connection include, but are not limited to, adhesion and elastic connection.

In this embodiment, a connecting component 4 is further provided. The second shell 12 is rotatably connected to the first shell 11 through the connecting component 4. The first shell 11 and the second shell 12 are rotatably connected, enabling the box body 111 and the lid 121 to open relative to each other, facilitating users in storing cards into the card storage box through the storage opening 33.

In this embodiment, the storage box main body 1 includes a front side 101 and a back side 102 opposite to the front side 101. The connecting component 4 includes a connecting component 40 for rotational connection and a limiting component 41 for positioning, the connecting component 40 and the limiting component 41 are located on the back side 102 of the storage box main body 1. An end of the connecting component 40 is connected to the first shell 11, and the other end of the connecting component 40 is connected to the second shell 12, enabling the second shell 12 to be rotatably connected to the first shell 11 through the connecting component 40. The second shell 12 is rotatably connected to the first shell 11 throught the connecting component 40, allowing the second shell 12 to switch between an open state 13 and a closed state 14. In this embodiment, the connecting component is a hinge structure. In other embodiments, the connecting component can also be a rotating shaft, a snap-fit, or other types of connections.

In this embodiment, the connecting component 40 includes a first connecting component 401 and a second connecting component 402. The first connecting component 401 is fixed to the first shell 11, and the second connecting component 402 is fixed to the second shell 12. The second connecting component 402 is rotatably connected to the first connecting component 401, enabling the second shell 12 to be rotatably connected to the first shell 11. The first connecting component 401 is also provided with a first fixing hole 4010, and the second connecting component 402 is provided with a second fixing hole 4020. A first end 411 of the limiting component 41 passes through the first fixing hole 4010, and a second end 412 of the limiting component 41 passes through the second fixing hole 4020. When the second shell 12 rotates to the open state 13, the limiting component 41 is configured to support the second shell 12 in the open state 13. When the card storage box is opened to a certain angle, the limiting component 41 locks between the first shell 11 and the second shell 12, preventing the lid 121 from opening further, restricting the maximum opening angle of the lid 121. The constraint imposed by the limiting component 41 prevents the lid 121 from colliding with surrounding objects, reducing the risk of damage, also avoiding unnecessary collisions of the lid with walls or other objects and ensures that the card storage box does not accidentally tilt or overturn.

In this embodiment, a switch component 5 is also provided. When the second shell 12 rotates to the closed state 14, the switch component 5 is configured to fix the second shell 12 in the closed state 14. The switch component 5 includes an upper switch component 52 and a lower switch component 51 opposite to the upper switch component 52. The upper switch component 52 is located on the second shell 12, the lower switch component 51 is located on the first shell 11. The switch component 5 also includes a third connecting component 53, the third connecting component 53 is configured to connect the upper switch component 52 with the lower switch component 51, thus securing the second shell 12 in the closed state 14. The third connecting component 53 includes a snap-fit 531 and a connecting ring 532. The connecting ring 532 is connected to the snap-fit 531, the connecting ring 532 is provided with a snap fastener 5321, the upper switch component 52 has a socket 521. When the snap fastener 5321 is inserted into the socket 521, pressing down on the snap-fit 531 secures the snap fastener 5321 in the socket 521, thus relatively fixing the upper switch component 52 to the lower switch component 51 and securing the second shell 12 in the closed state 14. Through the arrangement of the upper switch component 52, the lower switch component 51, the connecting ring 532, the snap-fit 531, and the snap fastener 5321, the switch component 5 can be easily operated to open and close, providing sufficient locking force. With the configuration of the switch component 5, the lid 121 remains closed when there is no need to access items inside the card storage box, preventing accidental opening of the flip cover, thereby maintaining the safety and neatness of the items inside the box.

In this embodiment, a handle component 6 is also provided, the handle component 6 is rotatably connected to the first shell 11. The first shell 11 is provided with a handle installation component 112, the handle installation component 112 is provides with an installation slot 1121. The handle component 6 is provided with a positioning post 61. When the positioning post 61 is inserted into the installation slot 1121, the handle component 6 can be rotatably installed to the handle installation component 112, enabling the handle component 6 to be rotatably connected to the first shell 11. Through the rotatable connection of the handle component 6 with the first shell 11, users can easily grasp the handle to carry the box from one place to another. Additionally, the handle component 6 can also serve as a handle, facilitating users in opening the box and quickly retrieving or placing items, thereby enhancing user convenience.

In this embodiment, an outer surface of the storage box main body 1 is covered with waterproof material. The waterproof materials include, but are not limited to, coating materials, polyethylene, polypropylene, and other materials. Typically, waterproof materials possess good durability and can extend the service life of the storage box.

In this embodiment, a back side 102 of the storage box main body 1 is also provided with support legs 7, the support legs include a first support leg 71 and a second support leg 72. The first support leg 71 is located on the first shell 11, and the second support leg 72 is located on the second shell 12. Since the back side 102 of the card storage box is provided with the connecting component 4 and cannot be placed flat directly on a placement surface, the configuration of the support legs 7 can elevate the card storage box, enabling the back side 102 of the card storage box to be stably placed on the placement surface.

In this embodiment, the storage box main body 1 also includes an anti-slip pad 8, the anti-slip pad 8 is located on a bottom surface of the first shell 11. The card storage box can also be placed on the placement surface. With the provision of the anti-slip pad 8, additional friction can be provided to prevent the storage box from sliding on the placement surface.

One or more implementation modes are provided above in combination with specific contents, and it is not deemed that the specific implementation of the present disclosure is limited to these specifications. Any technical deductions or replacements approximate or similar to the method and structure of the present disclosure or made under the concept of the present disclosure shall fall within the scope of protection of the present disclosure.

What is claimed is:

1. A card storage box, comprising:

a storage box body provided with a first accommodating space, the first accommodating space configured to store cards;

a flexible part arranged in the first accommodating space to protect stored cards; and a plurality of dividers arranged in the first accommodating space to divide the first accommodating space into a plurality of first storage spaces;

wherein the storage box body comprises a first shell body with a storage opening and a second shell body rotatably connected to the first shell body, and the first shell body and the second shell body jointly form the first accommodating space;

wherein the card storage box further comprising a connecting component, wherein the second shell body is rotatably connected to the first shell body through the connecting component;

wherein the storage box body comprises a front side and a back side opposite to the front side, the connecting component comprises a connecting component configured for rotational connection and a limiting component for positioning, and the connecting component and the limiting component are arranged on the back side of the storage box body;

wherein the second shell body is rotatably connected to the first shell body through the connecting component, allowing the second shell body to switch between an open state and a closed state;

wherein the connecting component comprises a first connecting component and a second connecting component, the first connecting component is fixed to the first shell body, the second connecting component is fixed to the second shell body, and the second connecting component is rotatably connected to the first connecting component, allowing the second shell body to be rotatably connected to the first shell body;

wherein the first connecting component further comprises a first fixing hole, and the second connecting component further comprises a second fixing hole, a first end of the limiting component is inserted into the first fixing hole, a second end of the limiting component is inserted into the second fixing hole, when the second shell body rotates to the open state, the limiting component is configured to support the second shell body in the open state.

2. The card storage box according to claim 1, wherein the storage box body further comprises a box body and a lid, the box body is arranged in the first shell body, and the lid is arranged in the second shell body, the box body and the lid together form the first accommodating space, and the first accommodating space is connected to outside through the storage opening.

3. The card storage box according to claim 1, wherein the dividers further comprises a first divider and a second divider, the first divider is configured to divide the first accommodating space into a plurality of first storage spaces, and the second divider is detachably installed in the first storage spaces to divide the first storage space into a plurality of second storage spaces.

4. The card storage box according to claim 3, wherein the first divider is provided with a plurality of installation slots, the second divider is provided with a installation component, the installation component is installed in the installation slots such that the second divider is able to be detachably installed in the first storage space and divide the first storage spaces into the plurality of second storage spaces.

5. The card storage box according to claim 4, wherein the second divider further comprises a pull component configured to the installation and detachment of the second divider in the installation slots.

6. The card storage box according to claim 2, wherein the flexible part is arranged in the first accommodating space and connected to the lid to protect the stored cards.

7. The card storage box according to claim 1, wherein an end of the connecting component is connected to the first shell body, and the other end of the connecting component is connected to the second shell body, allowing the second shell body to be rotatably connected to the first shell body through the connecting component.

8. The card storage box according to claim 1, further comprising a switch component, when the second shell body rotates to the closed state, the switch component is configured to fix the second shell body in the closed state.

9. The card storage box according to claim 8, wherein the switch component comprises an upper switch component and a lower switch component opposite to the upper switch component, the upper switch component is arranged on the second shell body, the lower switch component is arranged on the first shell body, the switch component also comprises a third connecting component, the third connecting component is configured to connect the upper switch component with the lower switch component, thus fixing the second shell body in the closed state.

10. The card storage box according to claim 9, wherein the third connecting component comprises a snap fastener and a connecting ring, the connecting ring is connected to the snap fastener, and the connecting ring is provided with a snap-fit, the upper switch component is provided with a socket, when the snap-fit is inserted into the socket, pressing down on the snap fastener causes the snap-fit to be fixed in the socket, thus relatively fixes the upper switch component to the lower switch component, thereby securing the second shell body in the closed state.

11. The card storage box according to claim 1, wherein the storage box body further comprises a handle component rotatably connected to the first shell body, the first shell body is provided with a handle installation component, the handle installation component is provided with an installation slot, the handle component is provided with a positioning post, when the positioning post is inserted into the installation slot, the handle component is able to be rotatably installed on the handle installation component, allowing the handle component to be rotatably connected to the first shell body.

12. The card storage box according to claim 1, wherein an outer surface of the storage box body is covered with waterproof material.

13. The card storage box according to claim 1, wherein the back side of the storage box body is also provided with support legs, the support legs comprises a first support leg and a second support leg, the first support leg is arranged on the first shell body, and the second support leg is arranged on the second shell body.

14. The card storage box according to claim 1, wherein the storage box body further comprises an anti-slip pad arranged on a bottom surface of the first shell body.

* * * * *